US006174269B1

(12) United States Patent
Eschenbach

(10) Patent No.: US 6,174,269 B1
(45) Date of Patent: Jan. 16, 2001

(54) PUSH-PULL TRACTOR EXERCISE APPARATUS

(76) Inventor: Paul William Eschenbach, 143 Lakeland Ave., Moore, SC (US) 29369

( * ) Notice: Under 35 U.S.C. 154(b), the term of this patent shall be extended for 0 days.

(21) Appl. No.: 09/440,546

(22) Filed: Nov. 15, 1999

(51) Int. Cl.[7] ..... A63B 21/00
(52) U.S. Cl. ..... 482/132; 482/127; 482/904
(58) Field of Search ..... 482/132, 127, 482/907, 116, 126, 121

(56) References Cited

U.S. PATENT DOCUMENTS 1,824,920 * 9/1931 Novak ..... 482/132
2,821,394 * 1/1958 Barbeau ..... 482/127
3,708,164 * 1/1973 Griffin ..... 482/127
3,752,475 * 8/1973 Ott ..... 482/127
6,017,296 * 1/2000 Tang et al. ..... 482/132

* cited by examiner

*Primary Examiner*—Jerome Donnelly

(57) ABSTRACT

The present invention relates to the field of knee down push-pull assistive exercise with a compact mobile exercise machine that exercises the abdominal, back and arm muscles in the kneel-prone-kneel movement. The push-pull tractor has a roller in contact with a random supporting surface, a handle offset to the roller axis to support a portion of operator body weight and an energy storage device that returns the tractor towards the starting position. In several embodiments, a wheel is added to the tractor to counteract windup torque energy.

20 Claims, 7 Drawing Sheets

PUSH-PULL TRACTOR EXERCISE APPARATUS

BACKGROUND OF THE INVENTION

1. Field

The present invention relates to the field of kneeling push-pull exercise apparatus. More particularly, the present invention relates to a compact mobile exercise machine that exercises the abdominal, back and arm muscles in the kneel-prone-kneel movement.

2. State of the Art

The benefits of regular exercise to improve overall health, appearance and longevity are well documented in the literature. One of the most difficult muscle groups to exercise is the abdominals. For exercise enthusiasts the search continues for safe apparatus that provides exercise to tone the abdominals without back strain.

Many devices have appeared recently to aid the user in the performance of situps from a prone face-up position with the intent of easing back strain. Situps, even with assistive devices, have low appeal and often the devices find their way to a permanent storage area.

Another abdominal exercise method developed by the Royal Canadian Air Force requires a person to start in a kneeling position on hands and knees, then push his body forward, sliding out along his hands until prone with arms extended. The exerciser then returns to the kneeling position by reversing the sliding action. This is a most difficult exercise and would not be embraced by the average exercise participant. However, with an assistive apparatus the kneeling to nearly prone to kneeling sequence can be most beneficial to exercise the abdominal, back and arm muscles.

Various roller and track devices have attempted to provide assistive kneel-prone-kneel exercise. Tolchin in U.S. Pat. No. 1,984,165 provides a track and hand trolley with a compression spring biased to return the hands to the kneeling position similar to the Torso Track marketed by Fitness Quest on TV. Mattox in U.S. Pat. No. 5,499,961 offers a roller/track device having elastic cords attached to a hand grip roller where the elastic cord is also attached near the knee to return the hand grip roller towards the knees.

Osbourne in U.S. Pat. No. 3,797,824 shows a number of tracks which allow push-pull exercise. Oswald in U.S. Pat. No. 5,518,483 shows a push-pull type exercise device for the kneel-prone-kneel sequence having separate trolleys for the knees and hands that can be fixed or sliding. Palacios in U.S. Pat. No. 5,921,901 adds an elbow rest trolley to the trolley/track kneel-prone-kneel method. Wang in U.S. Pat. No. 5,295,935 shows a stretching device that provides a pair of poles that slide on tracks connected by elastic bands. Agamian in U.S. Pat. Nos. 3,572,701 and 3,589,720 shows a trolley/track for gymnastic exercise with the feet. Cencig in U.S. Pat. No. 3,101,944 offers trolley/track exercise.

The simplest kneel-prone-kneel device is the classic exercise wheel. Shiek et al. in U.S. Pat. No. D306,886 shows a pair of wheels rollably attached to a straight rod used for hand grip. Novak in U.S. Pat. No. 1,824,920 uses a pair of inline wheels with brake. Wilkin in U.S. Pat. No. 4,136,867 offers an exercise wheel with roller teeth to vibrate the user during push-pull operation. Mattox in U.S. Pat. No. 5,261,866 adds elastic tubing to the handles where the knees hold the tubing while the operator is in the push mode to assist in the return mode. A spiral spring is added to the exercise wheel in R.O.C. Pat. 276503 and to a pair of wheels by Barbeau in U.S. Pat. No. 2,821,394.

Ott in U.S. Pat. No. 3,752,475 shows a single wheel having a handle concentric with the wheel pivot axis several methods of windup for assistive return including a spiral spring within the wheel, elastic resilient elements acting in one plane within the wheel and a torsion bar/spring or stranded cable within the handle. Chiou in U.S. Pat. No. 5,707,325 adds a pair of spiral springs intended to engage the handle at different positions of wheel movement for non-linear torque windup about the handle as an assisted exercise wheel.

Waldeck in U.S. Pat. No. 3,707,284 shows an exercise tractor with multiple wheels in contact with the floor attached to a seat with elastic bands intended for seated leg exercise.

The assisted trolley/track apparatus lack compactness and tend to be costly to fabricate. The assisted exercise wheel tends to strain the wrist as the hand must resist the windup torque and tend to have only one direction of movement. None of the prior art provides a compact self-contained apparatus that stores energy during the push mode and returns the handle to the kneeling position without wrist strain.

SUMMARY OF THE INVENTION

One objective of the present invention is to provide a compact trolley type device without tracks having internal energy storage that can be used directly on the floor or other inclined supporting surface for kneel-prone-kneel sequence of exercise.

Another objective of the present invention is a low cost exercise tractor having a low profile that can be stored under a bed.

Another objective of the present invention is an exercise tractor having hand grips that do not torque the wrists during kneel-prone-kneel exercise.

The present invention provides a compact push-pull exercise tractor having a roller in contact with a supporting surface such as the floor, a handle offset to the roller pivot axis and energy storage system. The operator begins in the kneeling position with hands on the tractor with arms generally near the vertical position. The hands push the tractor handle forward to a stopping position with the operator nearly prone. During the forward tractor movement, torque energy builds in the energy storage system. As the operator reverses the movement, torque energy drives the tractor towards the knees to assist the operator return to the kneeling position.

The tractor can build torque in either direction of movement from a starting position. The maximum return torque is determined by the distance traversed by the tractor and pre-torque bias. Pre-torque bias occurs when the tractor initiates ahead of the operator and is pulled back to a starting position. The reverse torque energy stored drives the tractor forward to the initiation position and the returning torque begins to build thereafter. Because the handle is offset to the roller axis, the stored torque energy does not strain the wrist. The tractor is also suitable for leg exercise where the operator is seated with bent legs for the starting position. With feet on the handle, the tractor is pushed forward to a stopping position with legs extended whereupon the torque energy stored would assist the legs return to a bent leg starting position.

In the preferred embodiment, a pair of rollers having textured exteriors are in contact with a supporting surface. The textured exterior can be a tread pattern or simply a sand grit adhered to the circumference for added traction to the support surface. The rollers are connected with a concentric windup surface that is a lesser diameter than the rollers. Each roller is connected at a pivot axis to a pair of side plates positioned parallel and out board of the rollers. A handle rod passes through and is attached to the side plates offset the roller pivot axis. A wheel is positioned adjacent each side plate to rotate about an axle shaft positioned distal the roller pivot axis. A concentric sleeve is positioned between the wheels to rotate freely upon the axle shaft.

A long elastic cord is attached to the windup surface proximate each roller. The elastic cord is spirally wound relaxed around the windup surface and wheel axle sleeve between elastic cord attachments. As the rollers turn, each end of the elastic cord is wound onto the windup surface to store torque energy. The intermediate elastic cord wraps provide a cord of sufficient length to accommodate multiple revolution wrapping needed to provide a long tractor stroke. During the return stroke, the elastic cord provides the torque energy needed to rotate the rollers thus assisting the operator back to the starting kneel position. The tractor will operate in either direction.

An alternate energy storage embodiment uses cable to wrap the windup surface in place of the elastic cord of the preferred embodiment. The cable spirally wraps an elongate pulley and the windup surface intermediate the cable attachments near the rollers. The elongate pulley has extension springs or other energy storage members connecting the ends of the elongate pulley to the side plates. Each additional intermediate wrap adds mechanical advantage allowing stronger springs. It is also possible to use elastic cord for the cable in conjunction with the springs for a variations in windup torque.

In another embodiment, a single elongate roller is in contact with the supporting surface. An axle shaft passes through the roller pivot axis and provides a wind up surface. Handles continue each end of the axle shaft offset to the roller pivot axis. A first elastic cord is attached at one end of the roller running generally alongside the axle shaft and connecting to the opposing end of the axle shaft. A second elastic cord connects the other roller end with the opposing axle shaft end. As the roller turns when pushed by the offset handles, the first and second elastic cords are spirally wound on the axle shaft to store torque energy. Additional elastic cords may be added for more torque. The handle offset prevents the torque build up from straining the wrists.

Another alternate embodiment, uses the elongate roller and lateral elastic cords for windup torque as the previous embodiment. The axle shaft terminates on either side of the elongate roller with side handles parallel to the roller movement being supported on the distal end by a wheel with each handle for tractor exercise.

In any of the above embodiments, the supporting surface can be inclined to vary the muscles exercised.

BRIEF DESCRIPTION OF THE DRAWINGS

The foregoing and other objects and features of the present invention will become more fully apparent from the following description and claims, taken in conjunction with the drawings. Understanding that these drawings depict only typical embodiments of the invention and are, therefore, not to be considered limiting of its scope or combinations, the invention will be described with addition specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 7, is not intended to limit the scope of the invention, as claimed, but is merely representative of the presently preferred embodiments of the invention.

Figure 1:
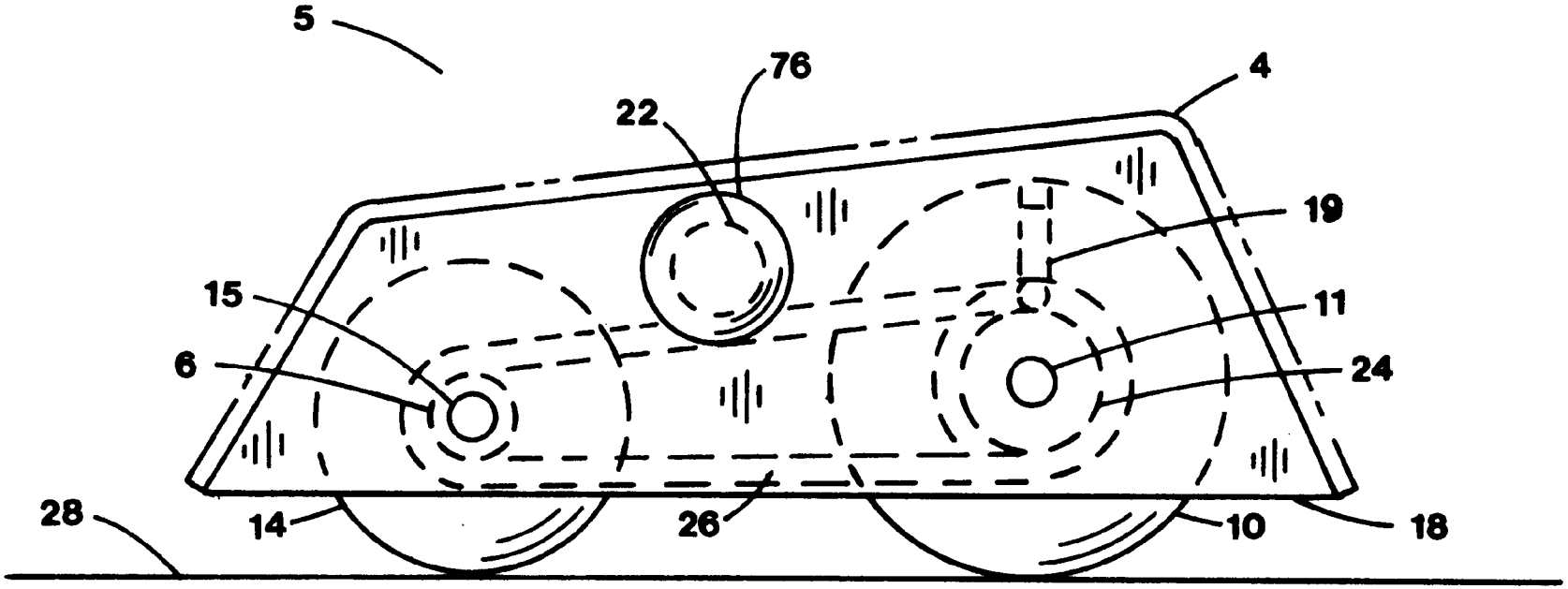
FIG. 1 is a side elevation view of the preferred embodiment of the present invention.
Figure 2:
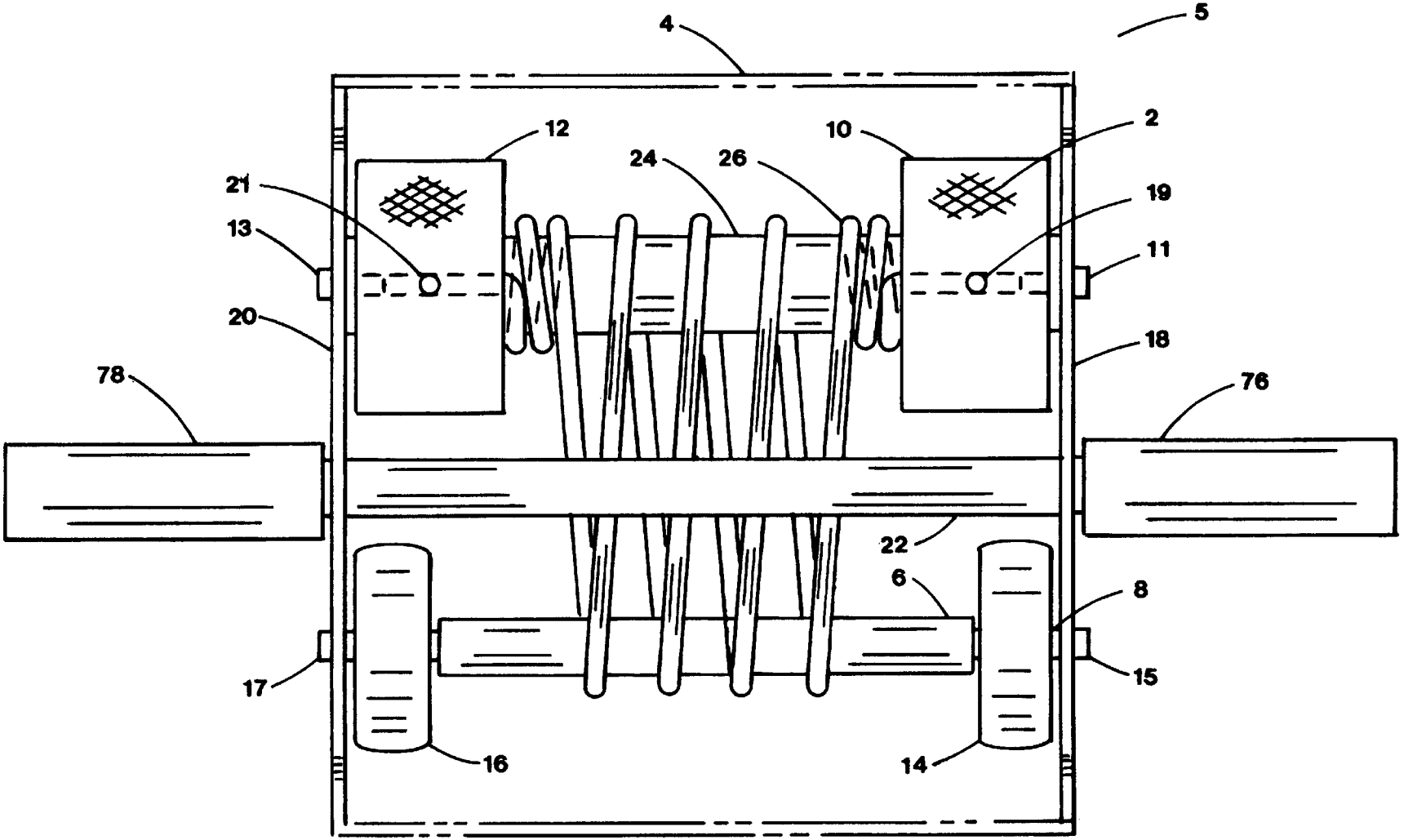
FIG. 2 is a top view of the preferred embodiment shown in FIG. 1.

In the preferred embodiment shown in FIGS. 1 and 2 show tractor 5 having rollers 10,12 in contact the supporting surface 28 with textured exterior 2. Rollers 10,12 are connected with concentric windup surface 24 and are connected to side plates 18,20 at pivots 11,13. Axle 8 is connected to side plates 18,20 at connections 15,17. Wheels 14,16 support axle 8 adjacent the side plates 18,20. An axle sleeve 6 is free to rotate about axle 8 between wheels 14,16. Handle rod 22 with hand grips 76,78 passes through and attaches to side plates 18,20 being positioned offset the roller pivot axis 11,13 between rollers 10,12 and wheels 14,16. Tractor cover 4 is not shown in FIG. 2 for clarity.

Elastic cord 26 is connected to rollers 10,12 at attachments 19,21. The elastic cord 26 is wound spirally around the windup surface 24 and axle sleeve 6. As the rollers 10,12 turn due to a force acting upon the handle 22, the elastic cord 26 wraps the windup surface 24 extending the elastic cord throughout to build-up and store torque energy. At the end of the stroke the force acting upon the handle 22 is lessened by the operator allowing the torque energy stored in the elastic cord 26 to drive the rollers 10,12 and tractor 5 back to a starting position.

Figure 3:
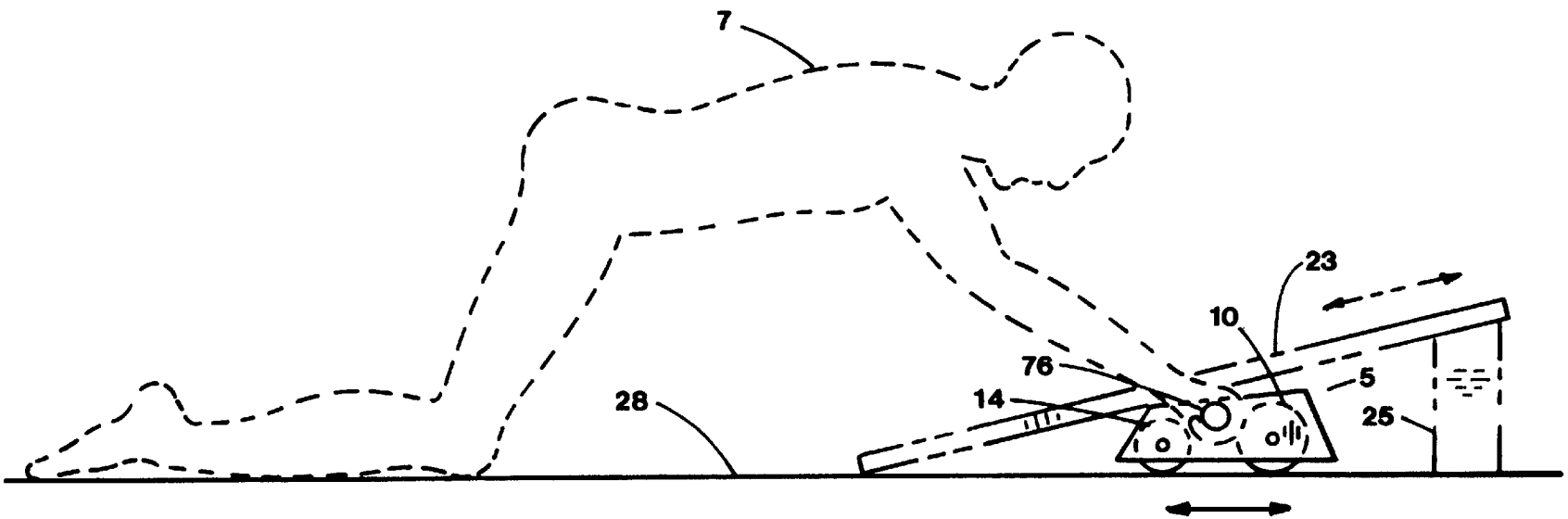
FIG. 3 is a side elevation view of the operator in the kneeling position using the preferred embodiment of FIGS. 1 and 2.

FIG. 3 shows the operator 7 in a kneeling position grasping handle rod 22 with handle grips 76,78. The push-pull tractor 5 is shown with rollers 10,12 and wheels 14,16 in contact with the floor acting as supporting surface 28. An alternate inclined supporting surface 23 with incline adjustment support 25 is also shown for tractor 5 operation.

Figure 4:
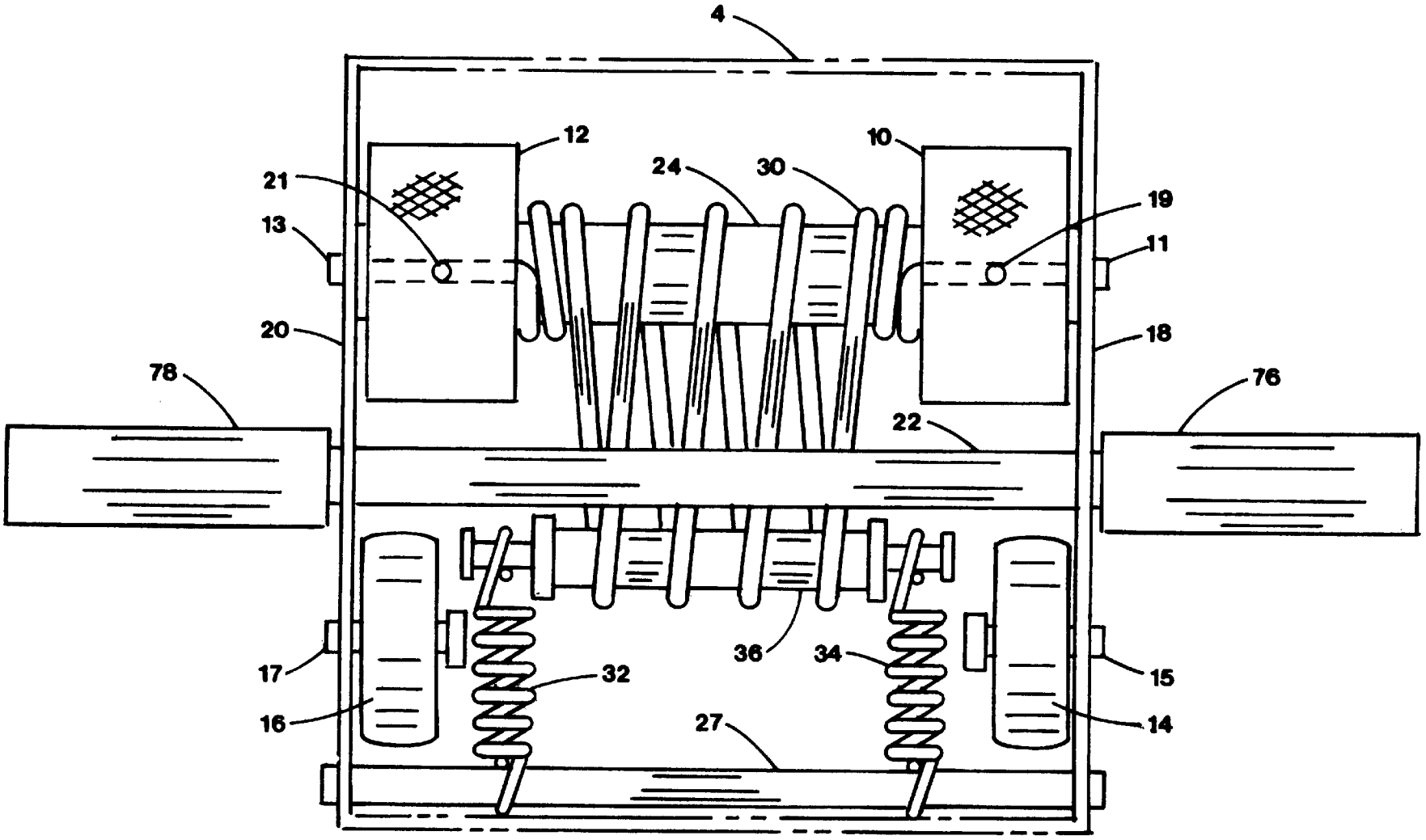
FIG. 4 is a top elevation view of a another embodiment of an alternate energy storage means.

An alternate energy storage embodiment is shown in FIG. 4 where cable 30 replaces the elastic cord 26 where each end of cable 30 is attached to rollers 10,20 at attachments 19,21. Intermediate the attachments 19,21, the cable is spirally wound over the windup surface 24 and elongated roller 36. Roller 36 is connected to spring support member 27 by extension springs 32,34. Operation is similar to the preferred embodiment in either direction of roller 10,12 rotation except that energy is stored in springs 32,34. If cable 30 is elastic, then energy would be also be stored in the cable. Wheels 14,16 are attached to side plates 18,20 with axle bolts 15.17.

Figure 5:
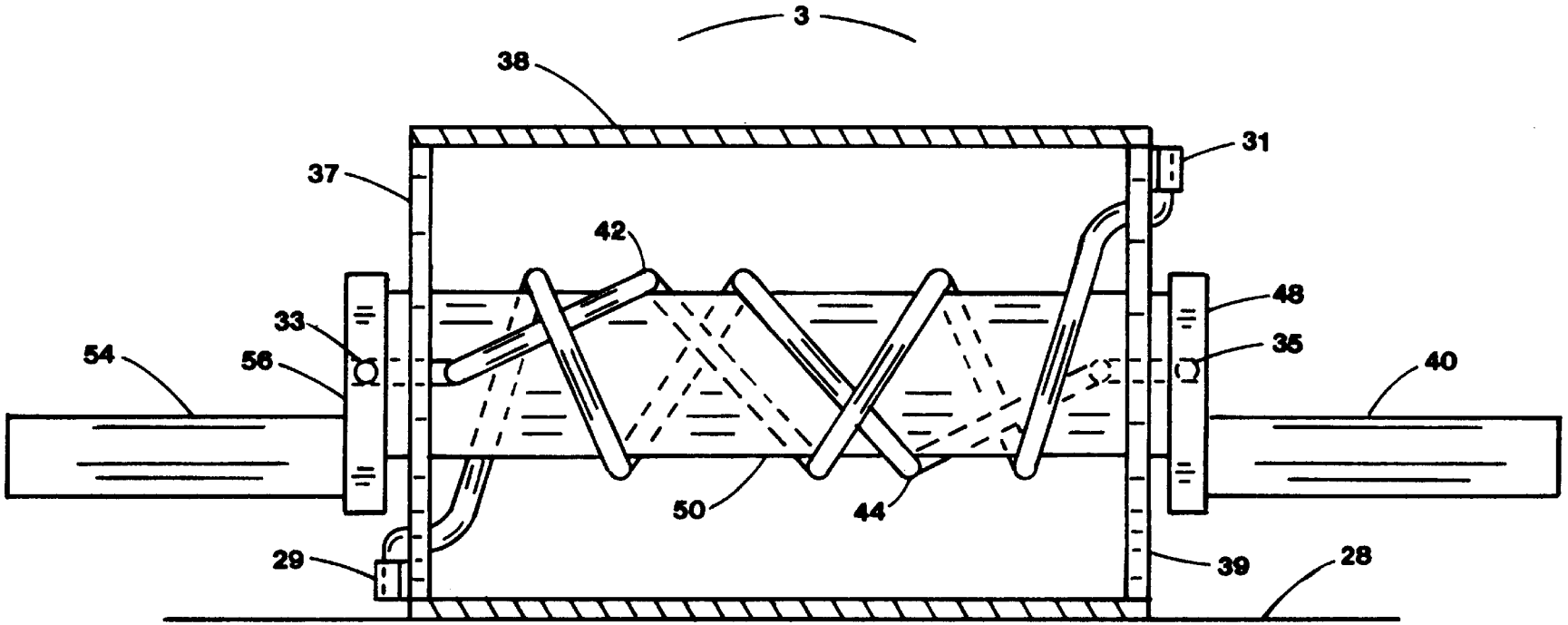
FIG. 5 is a front elevation view of an alternate embodiment of the present invention.
Figure 6:
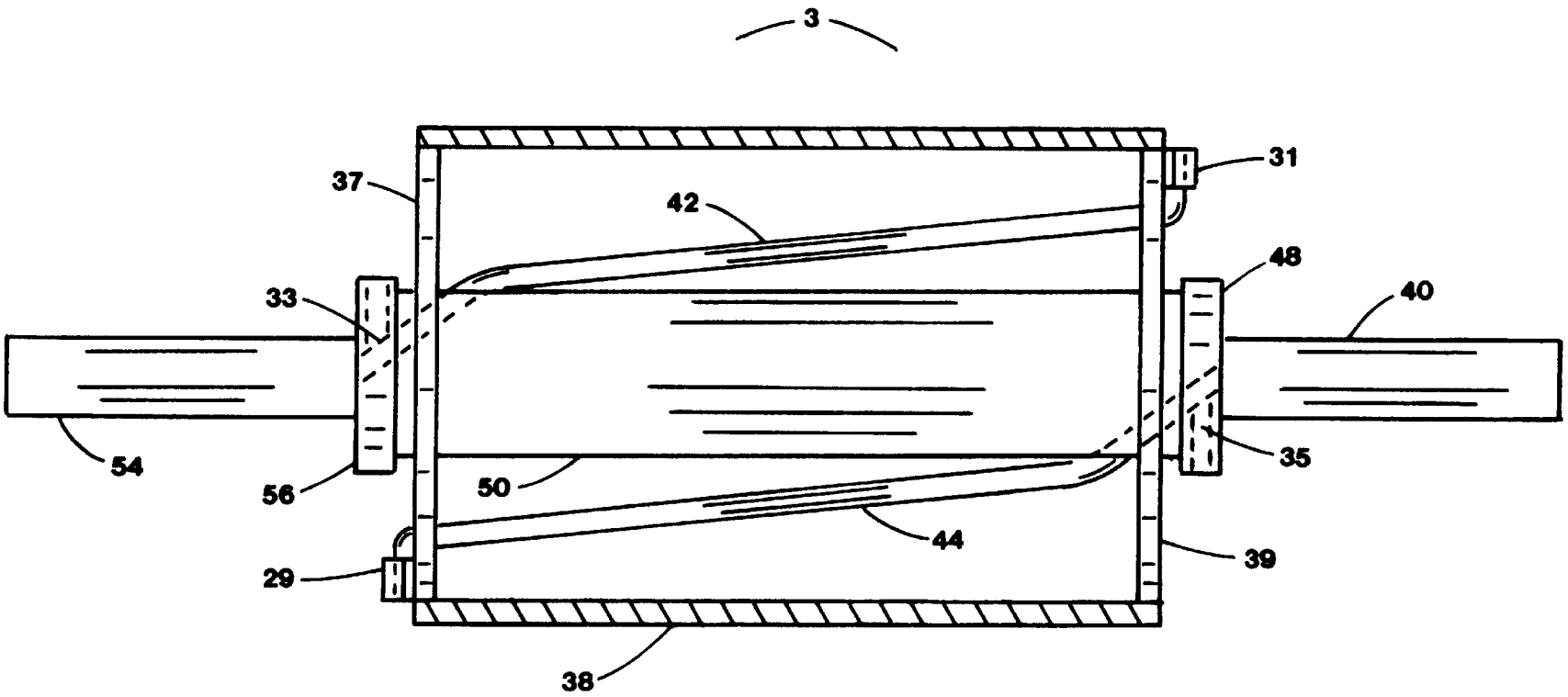
FIG. 6 is a top view of the alternate embodiment of FIG. 5.

An alternate embodiment is shown in FIGS. 5 and 6 as exercise tractor 3 where elongated roller 38 with textured exterior is in contact with support surface 28. Part of the roller shell 38 is removed for clarity. An axle shaft 50 is supported by roller bearings 37,39 and provides a windup surface within roller 38. Handles 40,54 are connected offset to axle shaft 50 by offset members 48,56. Elastic cords 42,44 are alternately attached at roller end plates 37,39 at fasteners 29,31 and axle shaft 50 ends with fasteners 33,35 as shown in FIG. 6. When an inclined force impinges upon handles 40,54, the roller 38 turns relative to axle shaft 50 causing elastic cords 42,44 to be wound on the axle shaft 50 as shown in FIG. 5 to store energy for return of the tractor 3 to a starting position. The tractor 3 may be moved in either direction with similar windup torque. The offset handle 40,54 prevent wrist strain.

Figure 7:
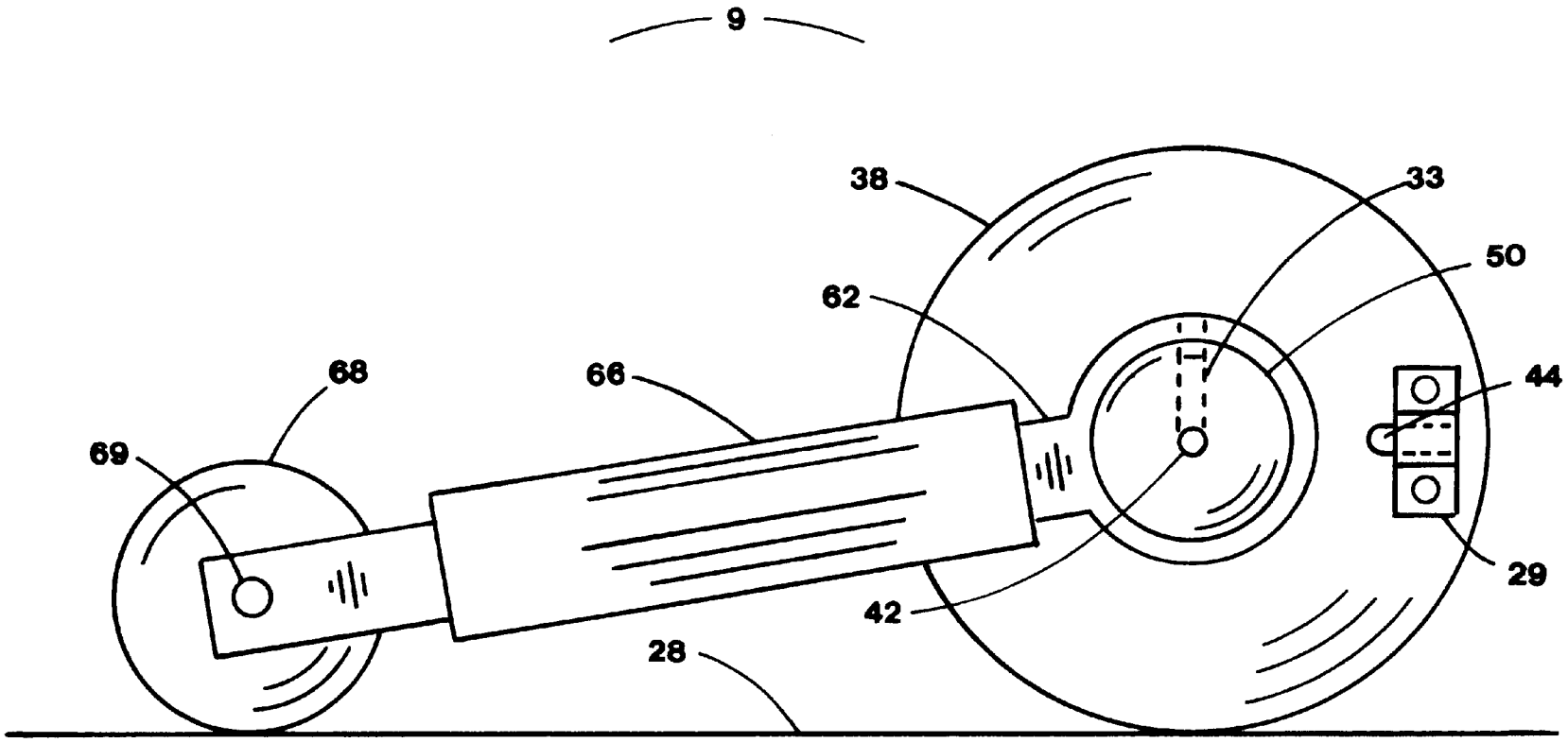
FIG. 7 is a side elevation of an alternate embodiment of the present invention.

Another embodiment is shown in FIG. 7 as exercise tractor 9 which uses the same roller 38, windup shaft 50 and elastic chords 42,44 as shown in FIGS. 5 and 6. The windup shaft 50 terminates each end with handle supports 62 which are supported on the ends away from the roller windup shaft 50 by wheels 68 pivoted at 69. Hand grips 66 are positioned between wheels 68 and roller windup shaft 50 on handle supports 62 generally parallel to the direction of movement for the tractor 9.

The advantages of the above tractor embodiments result from compactness and low cost to manufacture over prior art having trolleys engaged with tracks. The handles are offset to the roller axis to prevent wrist strain from torque build up with prior art assisted exercise wheels. The tractor can build up torque energy in either direction of movement. Portability and storage features are excellent. Torque build up at the end of the push stroke can be varied by initialization of pre-torque.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising;

a roller means, said roller means rollably engaged with a random supporting surface means to rotate about a pivot axis;

a handle means, said handle means positioned offset to said pivot axis to support a portion of operator body weight;

an energy storage means, said energy storage means operably associated with said roller means and said handle means;

said handle means movable from a starting position relative to said random supporting surface means by said operator whereby rotation of said roller means generates torque energy in said energy storage means that returns the handle means towards said starting position.

2. The exercise machine according to claim 1 wherein said energy storage means is an elastic member, said elastic member attached to said roller means and operably associated with said handle means.

3. The exercise machine according to claim 2 further comprising a windup surface for said elastic member, said windup surface positioned concentric with said roller means and having a lesser diameter than said roller means.

4. The exercise machine according to claim 3 further comprising an elastic member support means, said elastic member support means positioned generally parallel to said windup surface whereby said elastic member is spirally wound around said elastic member support and said windup means.

5. The exercise machine according to claim 1 wherein said energy storage means comprises;

a cable means, said cable means connected to said roller means;

pulley means, said pulley means in rollable contact with said cable means;

spring means, said spring means operably associated with said cable means and said pulley means.

6. The exercise machine according to claim 1 wherein said roller means has a textured exterior, said textured exterior in rollable contact with said random supporting surface means.

7. The exercise machine according to claim 1 wherein said random supporting surface means is the floor, said floor in rollable contact with said roller means.

8. The exercise machine according to claim 1 wherein said random supporting surface means further comprises means for adjustment whereby said random supporting surface means may be inclined relative to the floor.

9. The exercise machine according to claim 1 further comprising a tractor framework, said tractor framework pivotably connected to said roller means and attached to said handle means.

10. The exercise machine according to claim 9 further comprising wheel means, said wheel means rollably associated with said tractor framework.

11. An exercise machine comprising;

a handle, said handle configured to support the upper body weight of an operator;

a pair of rollers, said rollers in rollable contact with a supporting surface;

a mobile framework, said mobile framework attached to said handle and pivotally associated with said rollers;

a windup surface, said windup surface positioned concentric with and connecting said rollers;

a wheel, said wheel pivotally connected to said mobile framework and rollably engaged with said supporting surface;

means for energy storage, said means for energy storage operably associated with said windup surface and said mobile framework;

said handle movable from a starting position relative to said supporting surface by said operator whereby rotation of said rollers generates torque energy in said means for energy storage that returns the handle towards said starting position.

12. The exercise machine according to claim 11 wherein said means for energy storage is an elastic member, said elastic member attached to said windup surface and operably associated with said mobile framework.

13. The exercise machine according to claim 11 further comprising an axle to support said wheel, said axle connected to said mobile framework and operably associated with said means for energy storage.

14. The exercise machine according to claim 11 wherein said means for energy storage comprises;

a cable means, said cable means connected to said windup surface;

pulley means, said pulley means in rollable contact with said cable means;

spring means, said spring means operably associated with said pulley means and said mobile framework.

15. The exercise machine according to claim 11 wherein said rollers have a textured exterior, said textured exterior in rollable contact with said supporting surface.

16. An exercise machine comprising;

a roller means, said roller means rollably engaged with a random supporting surface to rotate about a pivot axis;

a handle means, said handle means positioned offset to said pivot axis to support a portion of the weight of an operator;

means for windup, said means for windup operably associated with said roller means and said handle means;

said handle means movable from a starting position relative to said random supporting surface by said operator whereby rotation of said roller means generates torque in said means for windup.

17. The exercise machine according to claim 16 further comprising a wheel means, said wheel means positioned offset to said pivot axis and rollably engaged with said random supporting surface.

18. The exercise machine according to claim 16 wherein said means for windup is an axle shaft, said axle shaft positioned offset and attached to said handle means.

19. The exercise machine according to claim 18 further comprising an elastic member, said elastic member attached to said axle shaft at one end and attached to said roller means proximate the other end of said axle shaft.

20. The exercise machine according to claim 16 further comprising hand grips, said hand grips attached to said handle means positioned orthogonal to said roller pivot axis.

* * * * *